United States Patent [19]

Mannhart

[11] Patent Number: 4,461,060

[45] Date of Patent: Jul. 24, 1984

[54] METHOD AND APPARATUS FOR REMOVING YARN REMNANTS FROM A BOBBIN

[75] Inventor: Felix Mannhart, Dietikon, Switzerland

[73] Assignee: F. Mannhart AG, Dietikon, Switzerland

[21] Appl. No.: 322,229

[22] Filed: Nov. 17, 1981

[30] Foreign Application Priority Data

Nov. 20, 1980 [CH] Switzerland ..... 8576/80

[51] Int. Cl.[3] ..... B65H 73/00

[52] U.S. Cl. ..... 28/295

[58] Field of Search ..... 28/292, 295, 297

[56] References Cited

U.S. PATENT DOCUMENTS

| | | | |
|---|---|---|---|
| 1,300,004 | 4/1919 | Peterson | 28/297 |
| 2,613,425 | 10/1952 | Whitaker | 28/295 |
| 3,298,078 | 1/1967 | Boer | 28/297 |
| 3,928,899 | 12/1975 | Maiworm | 28/295 |

FOREIGN PATENT DOCUMENTS

| | | | |
|---|---|---|---|
| 1962025 | 3/1971 | Fed. Rep. of Germany | 28/295 |
| 769290 | 3/1957 | United Kingdom | 28/297 |

*Primary Examiner*—Robert Mackey

*Attorney, Agent, or Firm*—Murray Schaffer

[57] ABSTRACT

Yarn remnants are automatically removed from a bobbin or the like by disposing the bobbin along a longitudinal axis substantially coinciding with its central axis and locating a cutter and at least two strippers about the longitudinal axis. The bobbin is then moved along the axis relative to the cutter and strippers while simultaneously moving the cutter and strippers radially toward the axis. The radial movement of said cutter and strippers is controlled in response to the axial movement of said bobbin through a template having a contour conforming to the shape of said bobbin, so that on the inward movement of the cutter and strippers in cooperation with the axial movement of said bobbin, the yarn is cut and removed.

12 Claims, 9 Drawing Figures

FIG.5
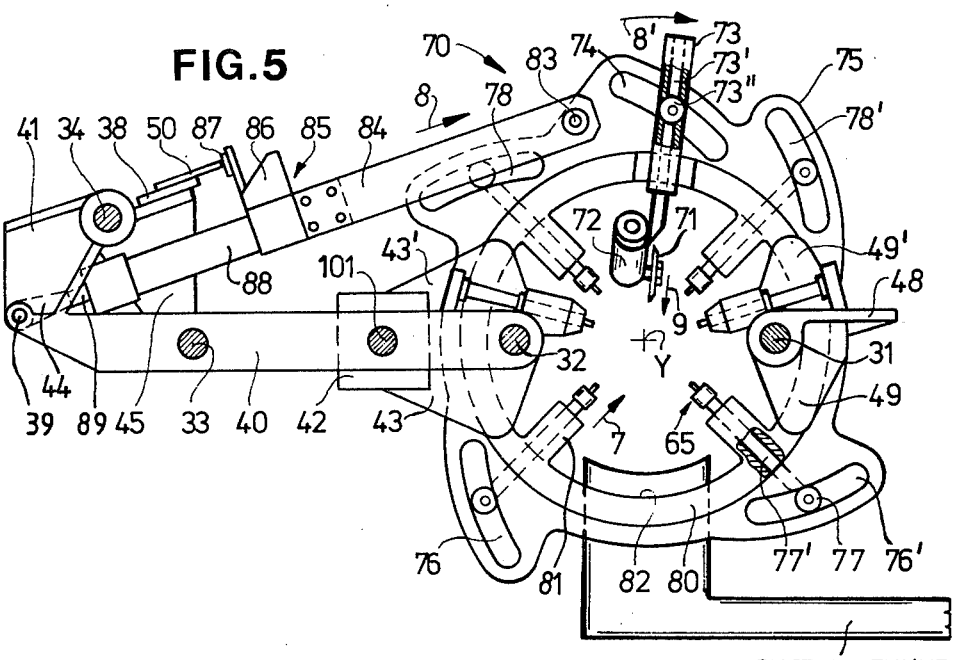
FIG.6
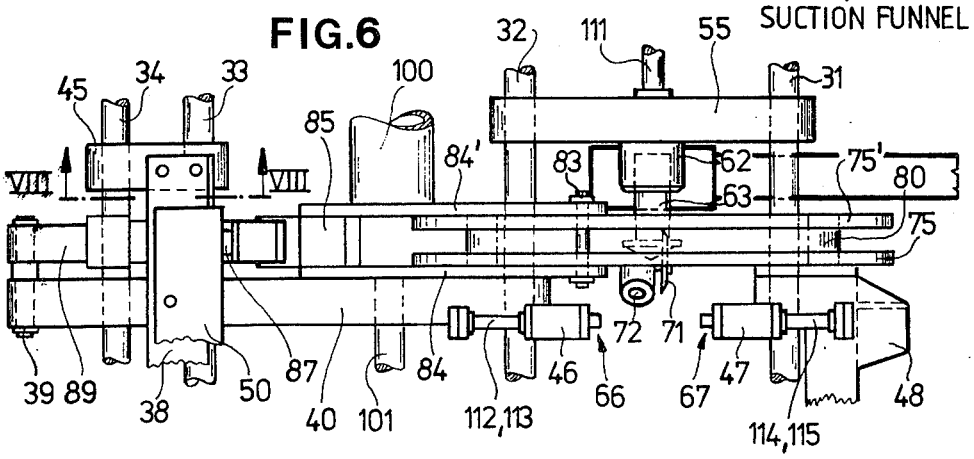
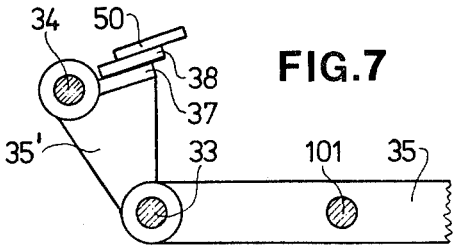
FIG.7
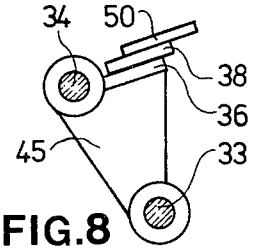
FIG.8

METHOD AND APPARATUS FOR REMOVING YARN REMNANTS FROM A BOBBIN

BACKGROUND OF THE INVENTION

The present invention relates to a method and to an apparatus for removing yarn remnants from a package such as a bobbin or the like.

Apparatus for the removal of yarn residues or remnants from a bobbin is disclosed in German Pat. No. 26 04 199. Such apparatus comprises a reciprocatably driven frame and an arm pivotably mounted on one end of the latter. At the free end of the arm there is mounted a cutting disk, driven in rotary manner and a mounting support for a sensor correspondingly associated with the cutting disk and which is resiliently and axially displaceably mounted in the mounting support. In this apparatus, the frame, together with the arm, cutting disk and sensor, are axially reciprocated along the bobbin. The sensor follows the contours of the bobbin and removes from the latter yarn remnants located thereon and they are subsequently cut by the cutting disk.

This known apparatus has a restricted application and is not, for example, suitable for modern, synthetic yarns. When cleaning bobbins with different surface characteristics, such as for example with a grooved or perforated surface, there exists the possibility that the sensor would rock into and stick in the surface structure and as a result either the surface or the complete bobbin can be destroyed.

German Publication, DAS 25 27 158 discloses a method and apparatus for removing yarn remnants from yarn carriers in which the yarn carrier is guided in an axial direction by apparatus equipped with stripping rings. Due to the dragging contact between rings and yarn, the yarn remnants are moved up to the rear end of the carrier and in two successive cutting processes, namely a coarse cut and a following fine cut are removed from the yarn carrier.

The present invention has, as its object, the removal of yarn remnants from a package or the like which obviate the disadvantages of the prior art and to develop a method and an apparatus by means of which, independently of the shape, surface characteristics and material of the package, as well as independently of the yarn type and quantity, a completely satisfactory removal of the yarn remnants from the package is obtained, without damaging the surface of the package.

These objects, as well as other objects and advantages, will be apparent from the following disclosure.

SUMMARY OF THE INVENTION

According to the present invention, yarn remnants are automatically removed from a bobbin or the like by disposing the bobbin along a longitudinal axis substantially coinciding with its central axis and locating a cutter and at least two strippers about the longitudinal axis. The bobbin is then moved along the axis relative to the cutter and strippers while simultaneously moving the cutter and strippers radially toward the axis. The radial movement of said cutter and strippers is controlled in response to the axial movement of said bobbin through a template having a contour conforming to the shape of said bobbin, so that on the inward movement of the cutter and strippers in cooperation with the axial movement of said bobbin, the yarn is cut and removed.

A pair of additional strippers are provided laterally spaced from the primary cutter and strippers which additional strippers are actuable on the reverse movement of the bobbin to dispose of the yarn previously cut from said bobbin.

The apparatus includes a frame having a plurality of guide rails parallel to the longitudinal axis. First and second movable supports are located on the guide rails in opposition to each other. Each of said movable supports has arranged thereon a clamping member adapted to engage a respective end of said bobbin and means for independently and jointly moving said supports parallel to the longitudinal axis. A fixed support is secured to the rails between said first and second movable supports and the primary cutter and strippers are mounted thereon.

Full details of the present invention are set forth in the following description of the preferred embodiment and are illustrated in the accompanying drawings.

BRIEF DESCRIPTION OF THE DRAWINGS

In the drawings:

FIG. 5 is an enlarged sectional view along the line V—V of FIG. 1, FIG. 6 is a plan view of the apparatus of FIG. 5, FIG. 7 is an enlarged sectional view along the line VII—VII of FIG. 1, FIG. 8 is an enlarged sectional view along the line VIII—VIII of FIG. 6, and;

DESCRIPTION OF THE INVENTION

Figure 1:
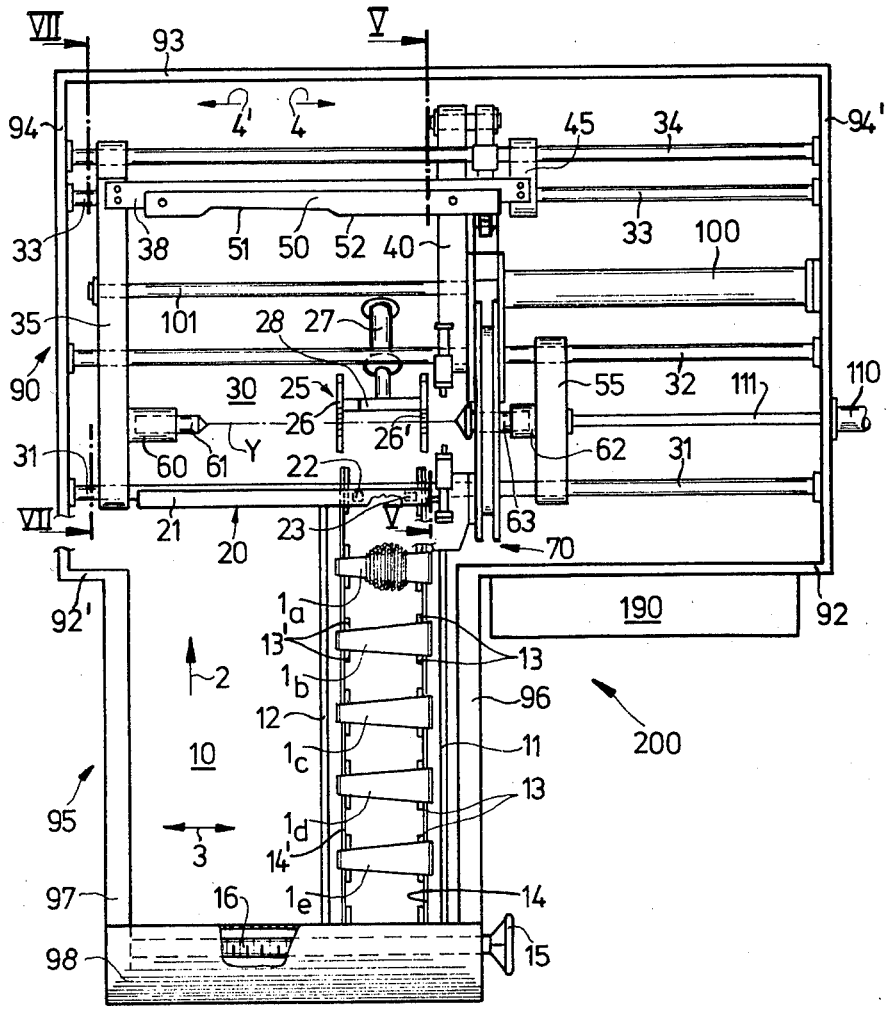
FIG. 1 is a plan view of the apparatus embodying the present invention.

In FIG. 1, a diagrammatic overall plan view of the apparatus for removing yarn remnants or residues on bobbins or the like is depicted, generally by the numeral 200. The apparatus is operated from a central control panel 190, and briefly comprises an infeed conveying section 10, a scanning section 20, a lifting section 25, a clamping and conveying section 30 and a cutting and stripping section 70, all of which are described in greater detail hereinafter.

The infeed conveying section 10 is formed of a frame 95 comprising two parallel supports 96 and 97 preferably covered on its front face by a hood 98. A conveyor mechanism comprising a first channel rail 11 and a second channel rail 12 is provided with a plurality of spaced carriers 13, 13' adapted to receive individual packages such as bobbins which are to be subsequent cleansed. The channel rails 11, 12 are U-shaped and are arranged with the openings opposed to each other. The carriers 13, 13' are operatively connected to drive chain 14, 14', which run through the channels 11, 12 respectively and about suitable drive and support wheels at each end, so that they may be indexed, stepwise in the direction of the arrow towards the scanning mechanism 20. To accommodate different sizes of packages, the second channel rail 12 is laterally adjustable in the directions of the double arrow 3 by means of a screw 16, mounted below the hood on a frame 95, by turning a hand wheel 15. The spacing between the two channel rails 11 and 12 is in each case to be set to the length of the package to be cleaned. As shown in FIG. 1, similar presorted packages $1_a$, $1_b$, $1_c$, $1_d$ and $1_e$ are placed on the conveyor.

The scanning section 20 comprises a transverse support 21 and two spaced scanning members 22, 23 arranged on the frontial side of the support facing the approaching bobbins. The scanners are movable so that they can be fed or directed upwardly into opposition with the oncoming package. Scanning member 23 is fixed against actual movement to the support, whilst the scanning member 22 is adjustable by not shown means in the direction of double arrow 3 in correspondence with the adjustment of the guide rail 12. The scanning members may be micro-switches, electric sensors, photo cells or the like, providing an electrical pulse, or pulse series on sensing of a package.

The sensors 22, 23 provide control impulses or signals for operation of the conveyor and for operation of the subsequent lifting, clamping and cutting sections. In the absence of contact with a bobbin, a first impulse from the sensors moves the conveyor, until a bobbin is placed directly below the sensors. In this portion, the sensors are raised until one of the sensors contacts the bobbin. If contact is made first, by sensor 23, then the correct position orientation according to the desired sorting shown in FIG. 1, of the bobbin is ascertained, and subsequent operation may proceed. If, on the other hand, contact is made first by sensor 22 then it is of course determined that the bobbin is in the wrong position for subsequent operation and movement of the conveyor and subsequent operation is temporarily arrested so that the incorrectly positioned bobbin can be removed. Conventional control means may be adapted for operation of the conveyor or lifting means, clamps and operation of the cutting elements and are therefore not shown here.

The lifting section 25 raises the individually supplied bobbins after they are scanned and places them into a clamping position. The lifting section comprises an arm-like mechanism having two spaced gripping members 26, 26' which are interconnected by a support 28 fixed at the end of the piston of cylinder motor 27. The support 28 is preferably constructed in such a way that the gripping member 26 is adjustable in correspondence with the associated scanning member 22 and guide rail 12 while the other gripping member 26' is fixed. In this manner, the members 26 and 26' may be adjustable to conform to the size of the bobbin. Gripping members 26, 26' are raised and/or lowered between the level of the carriers 13 and a predetermined position for the clamping and conveying process by operation of the cylinder 27 in an automatic manner.

The clamping section 30 is arranged in a second frame 90 formed of transverse and longitudinal supports 92, 92', 93, 94 and 94'. Mounted on the frame 90, to the movement of the bobbins, are spaced parallel guide rails 31, 32, 33 and 34, on which are arranged four support assemblies comprising a first displaceable support 35, a fixed support 40, a displaceable bearing block 45, and a second displaceable support 55. The rails 31, 32, 33, and 34 serve as mounting and guiding members for the supports 35, 40, 45 and 55 and are, thus, made in the form of sectional steel members preferably from round or rod steel and are fixed at their ends to the transverse supports 94, 94'.

The first displaceable support 35 is provided with an integrally formed bearing block 35' extending upwardly from its rear end (see FIG. 7). A connecting bracket 38 is fixed to the bearing block 35' and the bearing block 45 (see FIG. 8). A cylinder unit 100 having a piston 101 connected to the first support 35 is operable to reciprocate the support 35 and the attached block 45 in the direction of arrows 4, 4'. Another cylinder-piston unit 110, 111 is connected to the second displaceable support 55 and is operable to reciprocate it in the same directions.

The bracket 38 connecting support 35 to the bearing block 45 is used for the support and detachable fixing of a template 50. On the first displaceable support 35 is mounted a bushing 60 in which a conical clamp 61 is removably held. On the second displaceable support 55 there is mounted, in alignment with the cone 61, a similar bushing 62 in which a second detachable conical clamp 63 is held. Mounted on the fixed support 40 are the mechanisms of the cutting and stripping section 70.

From the larger scale view in FIG. 7, of part of the first displaceable support 35, it is possible to see the position of piston 101 and guide rod 33 which enables its movement and the bracket 38 which is mounted on a bearing block 35' preferably formed integrally with the support 35 extending upwardly from its rear end.

Figure 2:
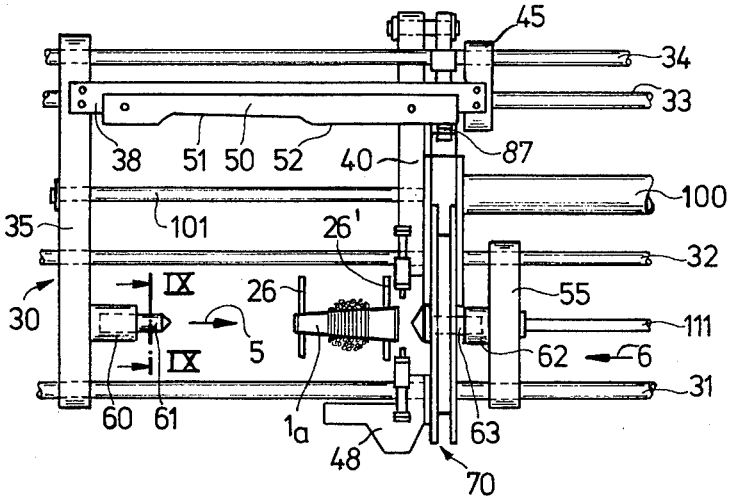
FIG. 2 is an enlarged view of a portion of the apparatus of FIG. 1 illustrating one stage of operation.
Figure 3:
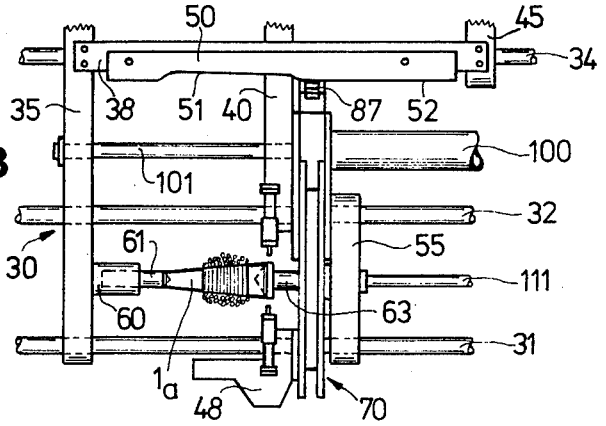
FIG. 3 is a view similar to FIG. 2 illustrating a succeeding stage of operation.
Figure 4:
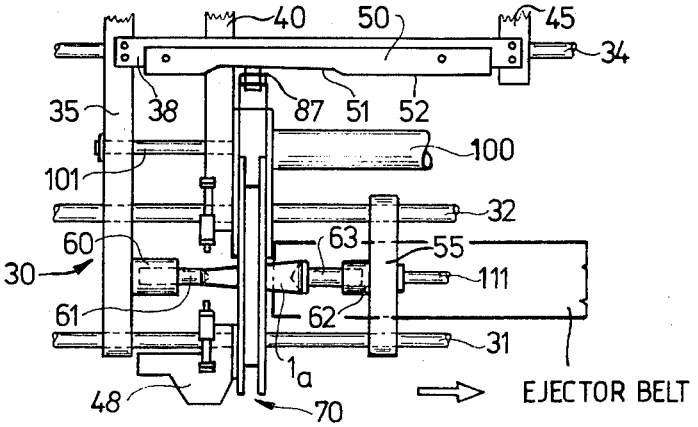
FIG. 4 is a view similar to FIGS. 2 and 3 illustrating still further stage of operation.

The different phases of the operations of the mechanisms of clamping section 30 with the relevant positions of the individual members and components are shown in FIG. 2, 3 and 4.

In the position seen in FIG. 2, a bobbin 1*a* is held in the gripping members 26, 26' of the lifting mechanism 25 in alignment with the cones 61 and 63. In this position, the first displaceable support 35 and its attached bearing block 45 is then moved by means of the piston-cylinder unit 100, 101 to the right in the direction of arrow 5, whilst support 55 is moved to the left in the direction of arrows 6 by piston-cylinder unit 110, 111, so that the cones 61 and 63, respectively, engage the opposite ends of the bobbin 1*a*, as seen in FIG. 3. Thereafter, the gripping members 26, 26' are disengaged and withdrawn, leaving the bobbin held only by the cones.

Subsequently, the first displaceable support 35 and second displaceable support 55 are both moved further to the right in the direction of arrow 6 until, as seen in FIG. 4, the clamped bobbin passes through the mechanism of the cutting and stripping section 70 where the yarn remnants may be cut and separated from the bobbin.

The mechanisms of the cutting and stripping section 70 are shown in the enlarged sectional view of FIG. 5 which is taken along the line V—V of FIG. 1 and in the plan view of the same section in FIG. 6.

The fixed support 40 is provided with boxes not shown for rails 32 and 33 and has extending upwardly at its rear end and on one side a bearing block 41 provided with a further bore through which guide rod 34 passes. Support 40 is fixed by not shown means to the same guide rails. On the front end of the support 40, there is symetrically arranged in a vertical plane two mirror image cover plates 43, 43' and spaced therefrom, there is provided a flange 42 for fixing the piston-cylinder unit 100, 101. A further supporting member 48 spaced forwardly from the fixed support 40 is fixed to guide 31. The supporting member 48 is also provided with two mirror image cover plates 49, 49' symetrically arranged relative to one another in the plane of the plates 43, 43'.

A vertical bearing ring 80 centered on the axis Y is fixed to cover plates 43, 43' of support 40 and cover plates 49, 49' of supporting member 48. Distributed uniformly about the inner periphery 82 of the ring 80 are bearing members 81 in each of which is mounted a primary stripping member 65 displaceable in the radial direction (arrow 7). It is noted at this point that the bearing members 81 and stripping members 65 are preferably constructed identically and for ease of viewing are provided only once with a reference numeral.

Two spaced plate cams 75, 75' are mounted about the outer periphery of the bearing ring 80 and are provided with curved recesses 76, 76'; 78, 78', in uniformly distributed manner, into which are fit a roller 77 operatively connected with an associated stripping member 65. A cutting member 71, mounted on a head 72 is located within the ring 80. The head 72 is secured to a rod 73' which passes through a slotted bracket 73 secured to the ring 80. A hole or space between the two upper cam recesses 78, 78' is provided in the periphery of the ring 80 to accomodate the bracket 73. The cutting member 71 is driven, preferably via a remote motor through a flexible drive shaft (Bowden cable).

A roller 73'' is secured to rod 73' and protrudes laterally, from the slot in the bracket 73, so that it rides in a curved recess 74 formed in the plates 75, 75'. In this manner, the radial extent of the cutter 71 is adjustable. A lever comprising two arms 84, 84', fixed at one end to the two plate cams 75, 75', by a pivot bolt 83, extends rearwardly from the bearing ring 80. The rear end of the lever is secured to a push pull hydraulic actuating mechanism 85, comprising a valve 86, a follower 87, and piston-cylinder unit 88, 89. The follower 87 is movably mounted to operate the valve 86 and is resiliently forced against the shaped edges 52, 51 of template 50 by a not shown spring. The valve 86 is connected to a source of fluid under pressure.

The piston 89 is journalled via a socket joint 44, on a shaft 39 extending through the end of support 40. The piston-cylinder unit 88, 89, actuated by the scanning valve 86, causes the extension of the lever formed by arms 84, 84' to reciprocate the two plate cams 75, 75' jointly in the direction of arrow 8.

Additional stripping members 66, 67 are laterally spaced from bearing ring 80, as seen in FIG. 6. The stripping member 66 is arranged in a bearing 46 on the support 40 while the stripping member 67 is arranged in a mounting 47 on the supporting member 48. Each of the stripping members 66, 67 is actuated by an associated pneumatic piston-cylinder unit 112, 113 and 114, 115, respectively, fixed to support 40 or supporting member 48 respectively, which are controlled independently of the hydraulically operated piston-cylinders.

The operation of the present apparatus is described hereinafter:

The bobbins of which $1_a$ to $1_e$ are illustrated, are placed on the carriers 13, 13' and are conveyed i.e. indexed as shown in FIG. 1 in the direction of arrow 2 by the conveyor 14, 14' serially toward the scanning section 20. As soon as the first package reaches the scanning section, a first pulse stops the conveyor and a second pulse brings the scanning members 22, 23 up to the package and if in the correct position,-in the represented embodiment, it is necessary in the case of conical bobbins to place the small diameter on the left-hand side of the conveyor belt as shown in FIG. 1 so that the larger end of the bobbin is subject to cutting and stripping first—it is fed to the lifting mechanism 25 by a further pulse which operates the conveyor. Mechanism 25 now brings the package located on carrier members 26, 26' into a clamping and conveying position, along the Y axis.

FIG. 2 shows the clamping phase in which the first displaceable support 35 with the first cone 61 is moved in the direction of arrow 5 by piston-cylinder unit 100, 101 and where the second displaceable support 55 and the second cone 63 is moved in the direction of arrow 6 by the second piston-cylinder unit 110, 111. As can be gathered from FIGS. 3 and 4, on further movement in the direction of arrow 5, the template 50, particularly cammed control edges 52, 51 is caused to move transverse past scanning member 87 simultaneously contacting the scanning member. Due to the shape of the cammed edge 51, 52, the scanning valve 86 is activated and, consequently, the two lever arms 84, 84' effect rotation of the cam plates 75, 75' of the cutting and stripping mechanism. The cammed edges 51, 52 are in mirror image to the conical shape of the bobbin and have the same conical angle.

The operation of the cutting and stripping mechanism 70 will now be described relative to FIG. 5. The thrust motion of the lever arms 84, 84' designated by arrow 8 is converted into a pivoting-rotating movement (arrow 8') of the two plate cams 75, 75' mounted on bearing ring 80 about the axis Y which is oriented substantially at right angles to the thrust motion. Due to the cooperation of the plates 75, 75', the cutter head holding device 73, the pivoting-rotating movement of the cam plates leads to a linear feed movement of the cutter 71 which is directed radially to axis Y and designated by arrow 9. The cutter 71 is driven in rotary manner about its central axis by not shown drive means, housed in the head 72. Simultaneously with the feed movement of cutter, the stripping members 65 are moved in radial, linear manner in the direction of arrow 7, consequently toward the bobbin at it passes through the mechanism 70. During this process, the pivoting-rotating movement of plate cams 75, 75' is converted into the feed movement designated by arrow 7 due to the forced guidance of rollers 77, in the cam slots 76, 76', 78, 78'.

The movement of the secured bobbin relative to the cutting and stripping mechanism 70, as well as the feed movement of cutter 71 and also the feed movement of primary stripping members 65 brought about by the interaction of the mechanisms and components described in detail relative to FIGS. 1 to 8, cause the cutter 71 to cut the yarn remnants from the bobbin which are then stripped or separated from the bobbin by stripping members 65.

Below the cutting and stripping section, a funnel member 120 can be placed, connected to a source of suction, so that the removed remnants can be carried easily away to a material container preferably arranged outside the area of apparatus 200.

During the return into their initial position of supports 35 and 55, the cones 61 and 63 release the cleaned yarn remnant-free bobbin which drops on to a conveyor belt 121, from which the bobbin is fed to a not shown collecting container.

The yarn remnants which may have been placed on the first clamping cone 61 during the cutting and primary stripping process are removed therefrom by the laterally spaced additional stripping member 66 positioned on support 40 and the stripping member 67 positioned on supporting member 48.

Figure 9:
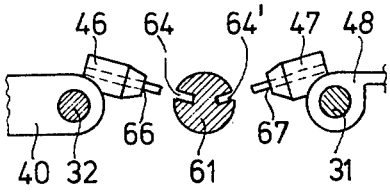
FIG. 9 is an enlarged sectional view taken along line IX—IX of FIG. 2.

FIG. 9 shows in detailed manner and in a sectional view that the clamping cones 61 and 63 are provided with slots 64, 64' which extend in the direction of the longitudinal axis Y. The stripping member 66 arranged on support 40 and stripping member 67 arranged on supporting member 48, conform to and are correspondingly associated with these slots, so that on moving the support 35 back into its initial position, the forwardmost stripping elements of stripping members 66 and 67 are insertable by the associated piston-cylinder units 112, 113 and 114, 115 into the slots 64, 64' so that the yarn remnants placed on clamping cone 61 are engaged, stripped and sucked off by the aforementioned suction device.

The operation of the cylinder units are controlled by a pulse signal derived automatically on the return or reverse movement of the supports. As a result of the special arrangement and construction of the individual mechanisms, particularly the cooperation of the clamping and lifting mechanism 30 and the cutting and stripping mechanism 70 substantially operated by template 50, a precisely controlled cutting and stripping process is obtained for the yarn remnants without any damge to the bobbin surface.

Tests have shown that the presently described apparatus can be used for the completely satisfactory and damage-free cleaning of packages with the most varied surface structures, e.g. smooth, grooved, studded, penetrated by differently shaped recesses, as well as packages with differently constructed end pieces. The completely satisfactory cutting and stripping process is also ensured for packages made from the most varied materials, e.g. hard paper, cardboard, plastic, wood, etc.

Various modifications, changes and embodiments have been shown and described and others will be obvious to those skilled in this art. Accordingly, it is intended that the disclosure be not limiting of the present invention.

I claim:

1. A method for automatically removing yarn remnants from a bobbin or the like, comprising the steps of (a) disposing said bobbin along a longitudinal axis substantially coinciding with its central axis, (b) locating a cutter and at least two strippers about said longitudinal axis and continuously rotating said cutter (c) moving said bobbin along said longitudinal axis relative to said rotating cutter and strippers, (d) simultaneously moving said rotating cutter and strippers in a radial direction toward said longitudinal axis, (e) locating a template having a contour conforming to the shape of the bobbin parallel to the axis of said bobbin and movable conjointly therewith, and (f) controlling the radial movement of said cutter and strippers toward said bobbin in response to the axial movement of said template, whereby the inward movement of said cutter and strippers in cooperation with the axial movement of said bobbin cause removal of the yarn thereon.

2. The method according to claim 1, comprising the additional steps of reversing the movement of each of said rotating cutter, strippers and said bobbin, and providing at least one additional stripper laterally spaced from said cutter and strippers, said at least one additional stripper being actuable on reverse movement of said bobbin to dispose of the yarn remnants not earlier removed therefrom.

3. Apparatus for removing remnants from a bobbin or the like, comprising means for mounting said bobbin for reciprocal movement along a longitudinal axis substantially coincident with its central axis, a cutter and at least two strippers, means for mounting said cutter and said strippers about the longitudinal axis, means for rotating said cutter and means for radially moving said cutter and strippers relative thereto, a template conforming to the shape of said bobbin, means for mounting said template parallel to the longitudinal axis for conjoint movement with said bobbin, and means responsive to the shape of said moving template for actuating the means for radial movement of said cutter and said strippers, whereby on movement of said bobbin in one direction toward said cutter and strippers, said cutter and strippers are moved into engagement with the yarn remnant on said bobbin and on reverse movement of said bobbin to move away from said bobbin.

4. Apparatus for removing yarn remnants from a bobbin or the like, comprising a frame having a plurality of guide rails, means for mounting said bobbin for reciprocal movement along a longitudinal axis substantially coincident with its central axis, said guide rails extending parallel to the longitudinal axis, a first and second movable support located on said guide rails in opposition to each other, each of said movable supports having arranged thereon a clamping member adapted to engage a respective end of said bobbin and means for independently and jointly moving said supports parallel to the longitudinal axis, a cutter and at least two strippers, means for mounting said cutter and said strippers about the longitudinal axis and for radially moving said cutter and strippers relative thereto, said means for mounting said cutter and strippers being located on a fixed support secured to said rails between said first and second movable supports a template conforming to the shape of said bobbin, and means responsive to the shape of said moving template for actuating the means for radial movement of said cutter and said strippers, whereby on movement of said bobbin in one direction toward said cutter and strippers, said cutter and strippers are moved into engagement with the yarn remnant on said bobbin and on reverse movement of said bobbin away from said cutter and strippers, the latter are moved radially away from said bobbin.

5. The apparatus according to claim 4 including a movable bearing block mounted on said rails, a bracket connecting said bearing block and the first of said movable supports, said template being mounted on said bracket to move transversely to said fixed support.

6. The apparatus according to claim 5 wherein the means for mounting said cutter and strippers comprises a bearing ring, secured to said fixed support with its center coincident with the longitudinal axis, said cutter and strippers being mounted in said ring to be movable radially substantially toward said center, a pair of annular plate cams disposed parallel to each other about the periphery of said bearing ring, follower means connecting said cutter and strippers to said plate cams in contact with said template to rotate said plate cams and radially move said cutter and strippers.

7. The apparatus according to claim 6 wherein said plate cams are provided with curved recesses forming cam surfaces for said follower means.

8. The apparatus according to claim 7 wherein said cutter and strippers are each formed on the end of a rod, each said rod being held in a sleeve bearing, each rod being provided with a roller comprising said follower means.

9. The apparatus according to any one of claims 4 through 8 including two additional strippers, one mounted on said fixed support, the other mounted on said frame, both being located laterally of said cutter and first strippers, said additional strippers being actuable to remove said yarn remnants on the reverse movement of said bobbin.

10. The apparatus according to claim 9 wherein said clamping members are each provided with a slot extending parallel to the longitudinal axis in association with each of said additional stripers, said slots conforming to the shape of said additional strippers for introduction of said strippers therein.

11. The apparatus according to claim 9 including suction means for collecting and transporting said yarn remnants away from said apparatus.

12. The apparatus according to claim 9 including means for successively feeding bobbins to said means for mounting said bobbins.

* * * * *